United States Patent [19]

Coody

[11] 4,031,733

[45] June 28, 1977

[54] APPARATUS FOR BENDING TUBULAR MEMBERS

[76] Inventor: John L. Coody, 5514 Aldine-Bender, Rte. 16, Houston, Tex. 77032

[22] Filed: Oct. 15, 1976

[21] Appl. No.: 732,756

[52] U.S. Cl. ..... 72/166; 72/DIG. 22; 72/386

[51] Int. Cl.[2] ..... B21C 7/04; B21C 7/12

[58] Field of Search ..... 72/166, DIG. 22, 215, 72/388

[56] References Cited

UNITED STATES PATENTS

| | | | |
|---|---|---|---|
| 3,406,551 | 10/1968 | Coody | 72/166 |
| 3,821,525 | 6/1974 | Baton et al. | 72/DIG. 22 |

*Primary Examiner*—Milton S. Mehr
*Attorney, Agent, or Firm*—Pravel, Wilson & Gambrell

[57] ABSTRACT

Apparatus for bending tubular members such as pipe including a frame, a carriage-mounted gripping device for feeding the pipe longitudinally along the frame, a set of bending dies for receiving and bending the tubular member as the tubular member is fed therethrough, and a radius setting assembly positioned to engage and further bend the tubular member along a predesignated radius of curvature. The movement of the radius setting member and the feeding assembly for moving the tubular member longitudinally is coordinated and synchronized such that the radius setting member and carriage-mounted gripping device moving the tubular member are moved synchronously to arrive at predesignated positions during a first portion of the bending cycle thereby applying a predesignated radius to the tubular member evenly and uniformly.

22 Claims, 15 Drawing Figures

14
F-1
F-2
T
100b
A
12a
12
92
G
11
88a
93
90a
90b
88b
97a
87a
87b
96
10
15
42b
68a
71
68
67b
69
67a
16
42a
52
41b
44a
44
43
40
53
57
17
55
41a
30

Fig. 9A
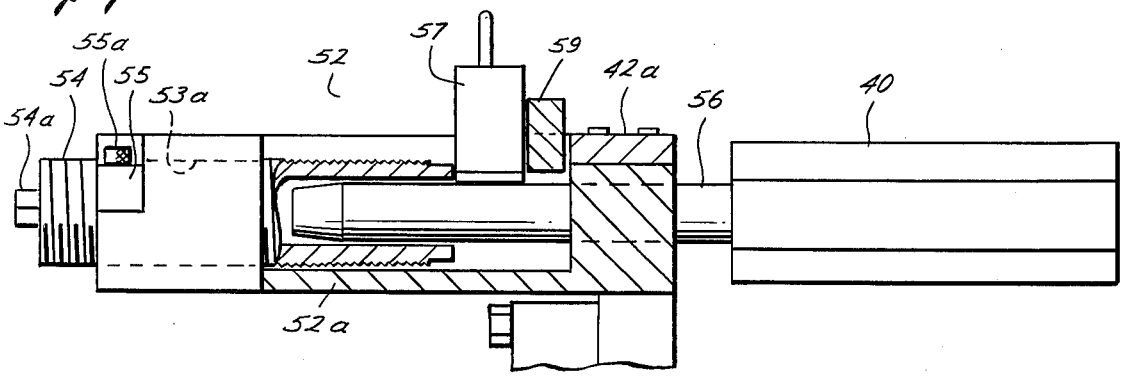
Fig. 9B
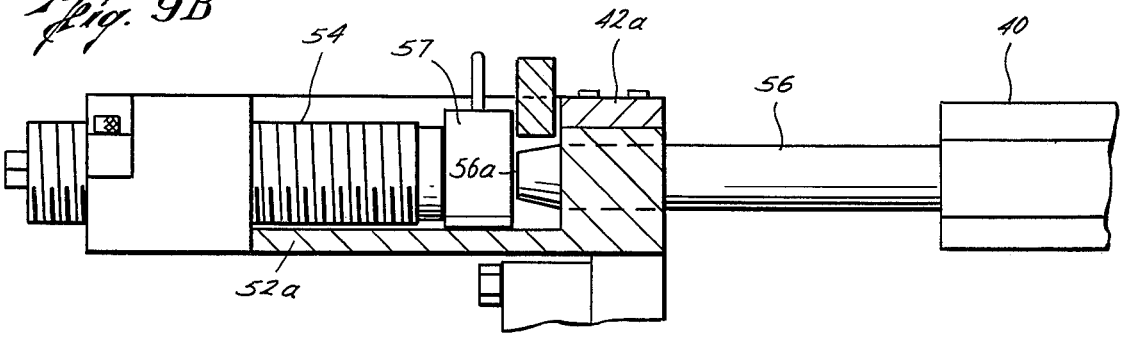
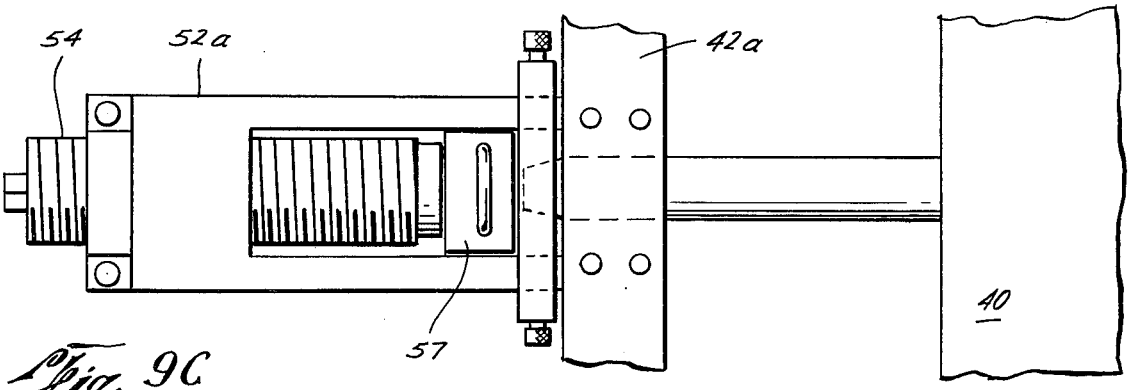
Fig. 9C

APPARATUS FOR BENDING TUBULAR MEMBERS

BACKGROUND OF THE INVENTION

The field of this invention is apparatus for bending tubular members such as pipe, thin-walled tubing and the like.

The pipe bending machine of U.S. Pat. No. 3,406,551 was invented by the inventor of the improved pipe bending apparatus disclosed here. The pipe bending machine of U.S. Pat. No. 3,406,551 basically includes a pipe moving mechanism for engaging and moving a piece of pipe longitudinally along a frame; a pair of die members forming a cylindrical passageway to receive and initially bend the pipe and a radial bending arm for engaging and applying a predetermined radius of curvature to the pipe. In actual practice, the machine disclosed in U.S. Pat. No. 3,406,551 has been a very successful machine. The bending cycle such as disclosed in this patent is basically a two-step cycle. During the first step or phase, the pipe moving mechanism feeds the pipe longitudinally through the bending dies and into engagement with the radius setting arm. At the same time, the radius setting arm is pivotally moved from an initial position wherein the straight piece of a pipe is initially engaged to a final, radius-setting position. After the radius setting arm has been moved to the predesignated position for applying the proper radius of curvature, the radius setting arm is held in that position during a second part of the bending cycle wherein the pipe is fed further through the machine by the pipe moving mechanism. Thus, the process of simultaneously moving the radial setting arm to its operative position while feeding the pipe through the bending dies is well known in the art as a result of this patent and perhaps others. Reference is made to U.S. Pat. Nos. 783,716; 913,004; 967,599; 1,515,894; 1,567,107; 1,816,218; 1,943,700; 2,357,006; 2,996,100; 3,116,779; 3,145,756; 3,896,649; and 3,902,344.

SUMMARY OF THE INVENTION

It is an object of this invention to provide a new and improved apparatus for applying a bend to a tubular member such as pipe or the like wherein the bend produced is extremely uniform due to a coordination of initial movement of the radial setting means with longitudinally movement of the tubular member.

It is further an object of this invention to synchronize the movement of the radius setting equipment with the movement of the tubular member therethrough in order to produce such uniform bends.

It is further an object of this invention to provide a new and improved apparatus for bending tubular members wherein movement of a radius setting assembly is controlled independently of movement of the pipe moving mechanism so that the rate of travel of the tubular member through the bending dies and past the radius setting member may be completely adjusted as desired.

These objects and other objects to this invention will be described in greater detail hereinafter.

The new and improved bending apparatus of the preferred embodiment of this invention for bending a tubular member such as pipe or the like includes a gripping device mounted in a reciprocating carriage. The carriage is movable in a longitudinal direction along the frame and includes gripping elements to engage and move forwardly a tubular member, thereafter release the tubular member and return to an initial position for gain gripping the tubular member and feeding it forward. The tubular member is fed first through opposed bending dies for applying the initial bend to the pipe. The pipe is then engaged by a radius setting shoe for applying a predesignated radius to the tubular member. The movement of the radius setting member is coordinated with the rate of travel of the gripping device, and thus of the tubular member, so that the bend produced in the tubular member is of uniform radius.

The radius setting member is mounted onto the frame for transverse movement between an initial and a radius applying position. Power control means are provided for controlling the gripping and feed mechanisms, the bending dies and movement of the radius setting assembly. The power control means provides means for synchronizing the movement of the radius setting assembly with movement of the gripping mechanism, and thus of the tubular member to be bent, in order to apply a bend having a substantially uniform radius of curvature. In order to accomplish this, the power control means synchronizes the movement of the radius setting assembly with movement of the gripping mechanism such that the gripping mechanism and the radius setting member arrive at predesignated points at the end of a first phase in the bending cycle at the same time with only the gripping mechanism being thereafter moved against the radius setting mechanism.

Additional objects and additional features of this invention will be described in the detail description and claimed herein. The claims set forth at the end of the detailed description of the preferred embodiment are the sole descriptors of the invention set forth herein, the summary of the invention being intended as no more than that.

BRIEF DESCRIPTION OF THE DRAWINGS

FIGS. 9A–9C illustrate the radial shoe locking mechanism of this invention;

DESCRIPTION OF THE PREFERRED EMBODIMENT

Figure 1:
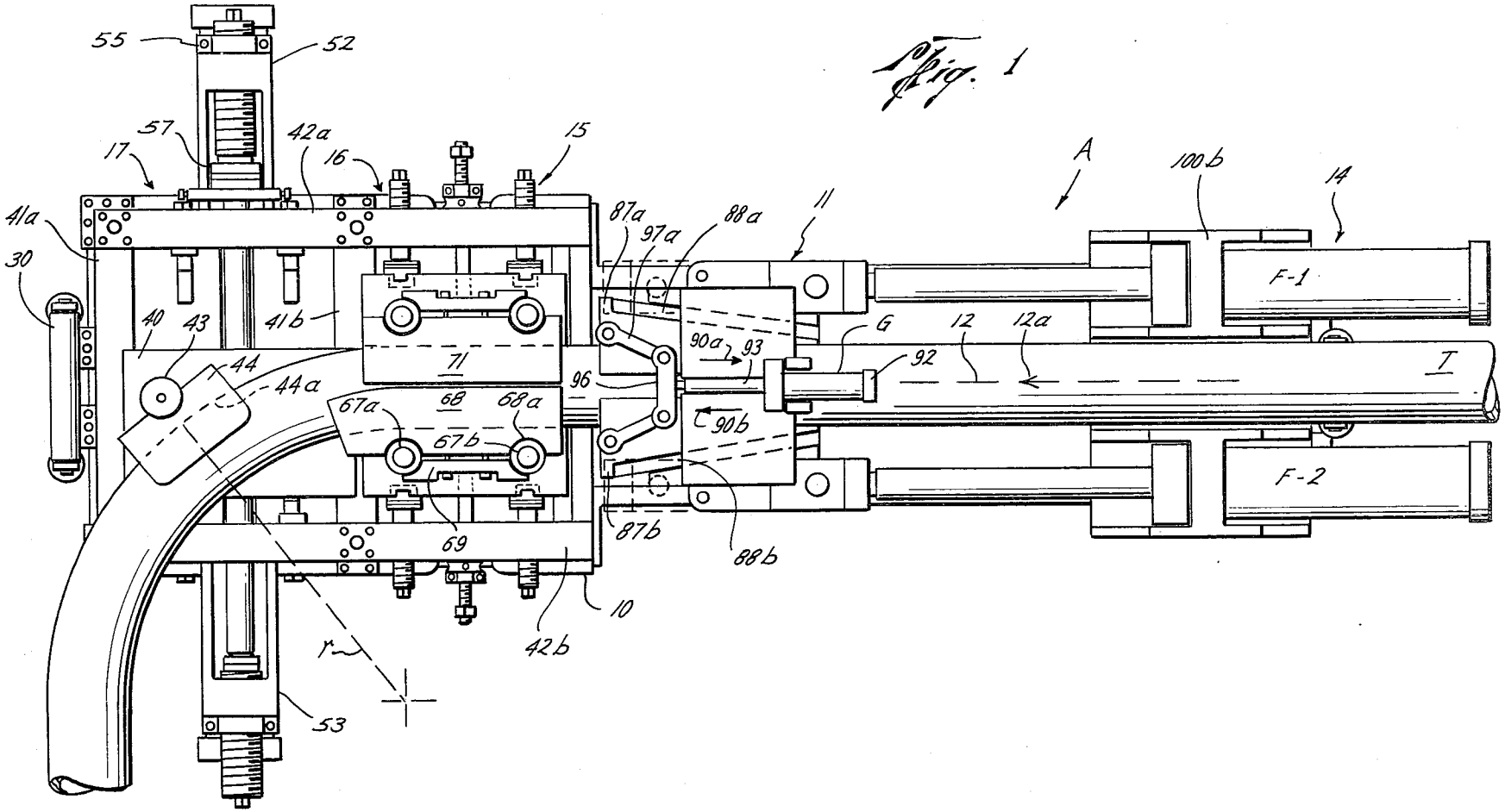
FIG. 1 is a top view of the improved bending apparatus of a preferred embodiment of this invention.
Figure 2:
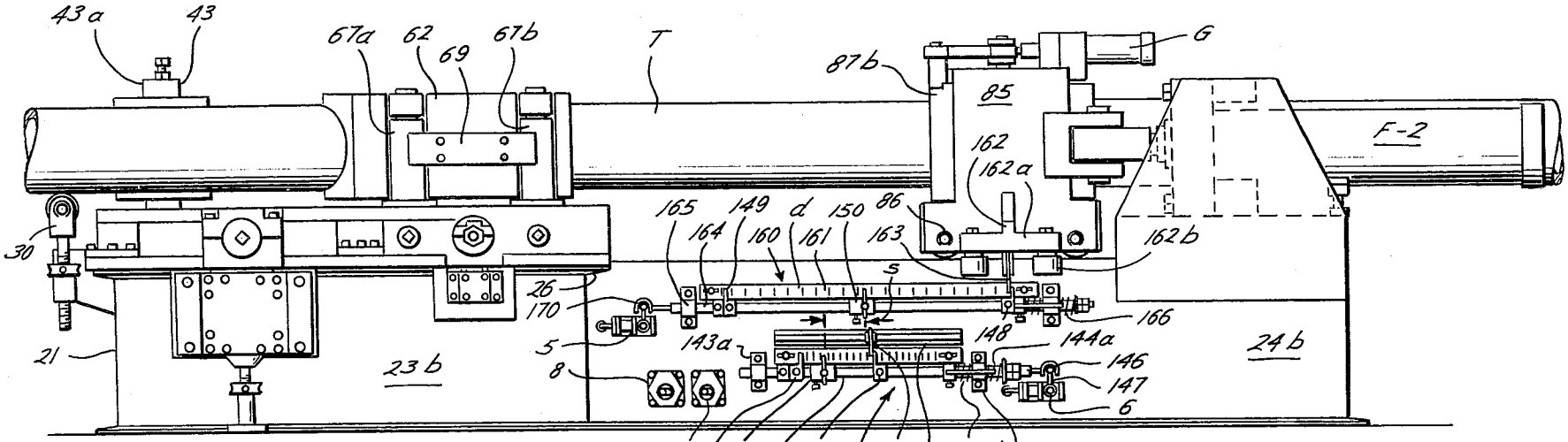
FIG. 2 is a side view of the bending apparatus illustrating the longitudinal and radial scales.
Figure 3:
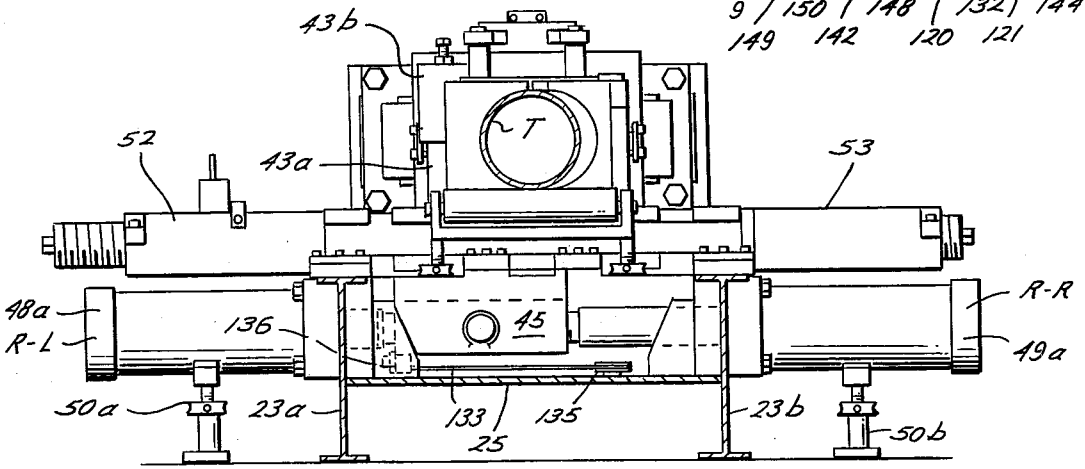
FIG. 3 is a front view of the pipe bending apparatus.
Figure 4:
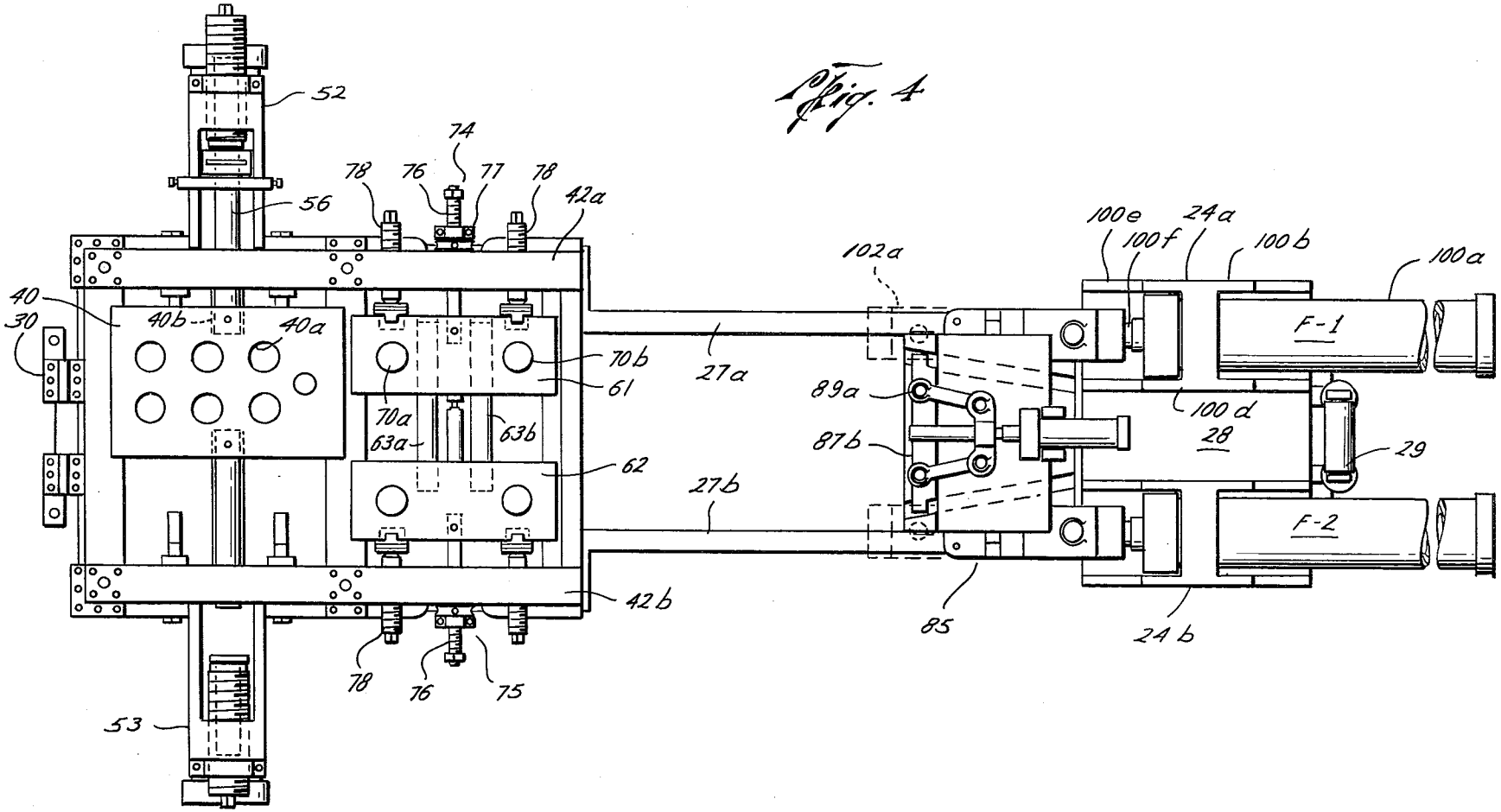
FIG. 4 is a top view partly in section of the bending apparatus.
Figure 5:
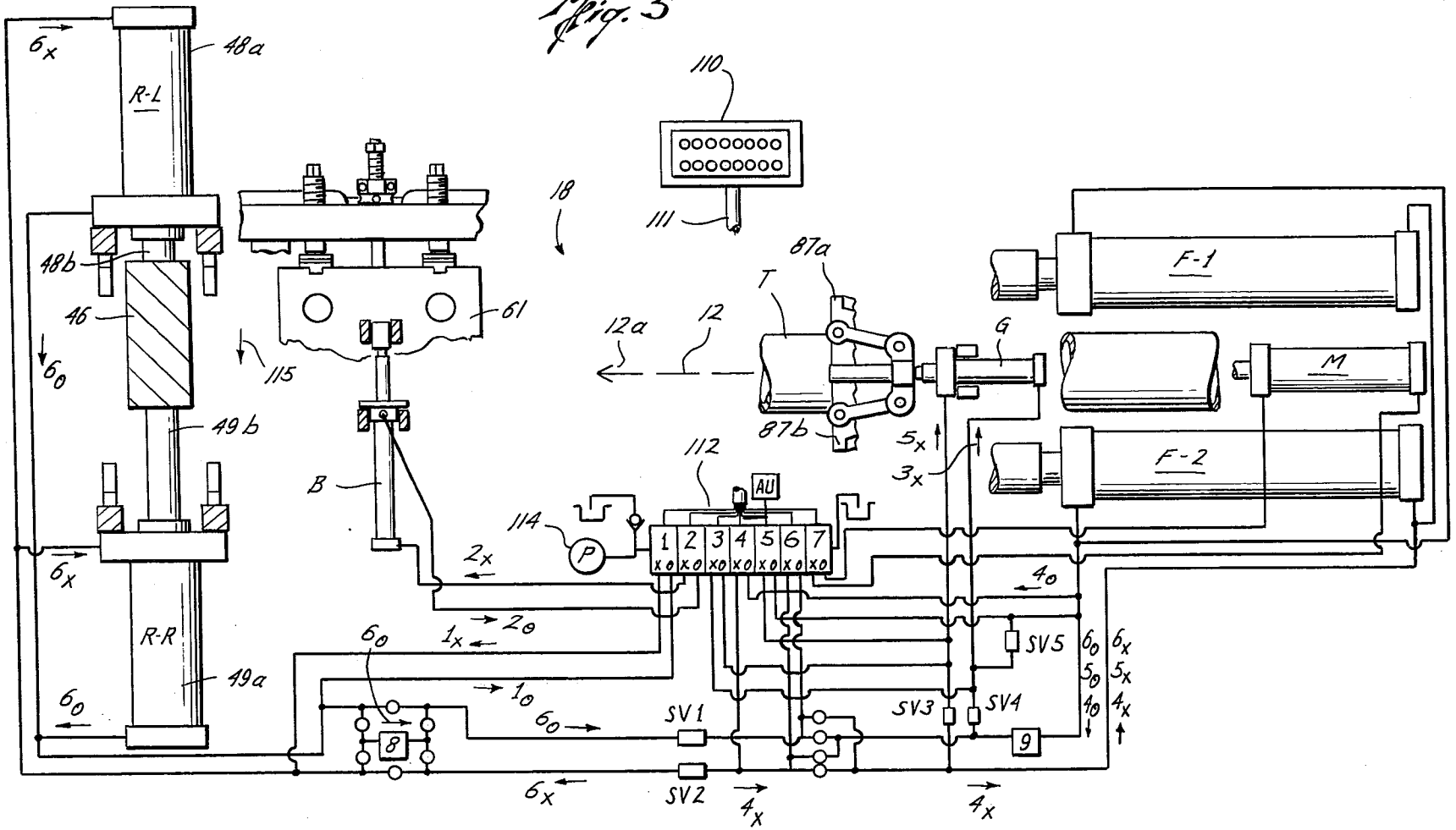
FIG. 5 is a schematic view of the power control system of this invention.
Figure 6:
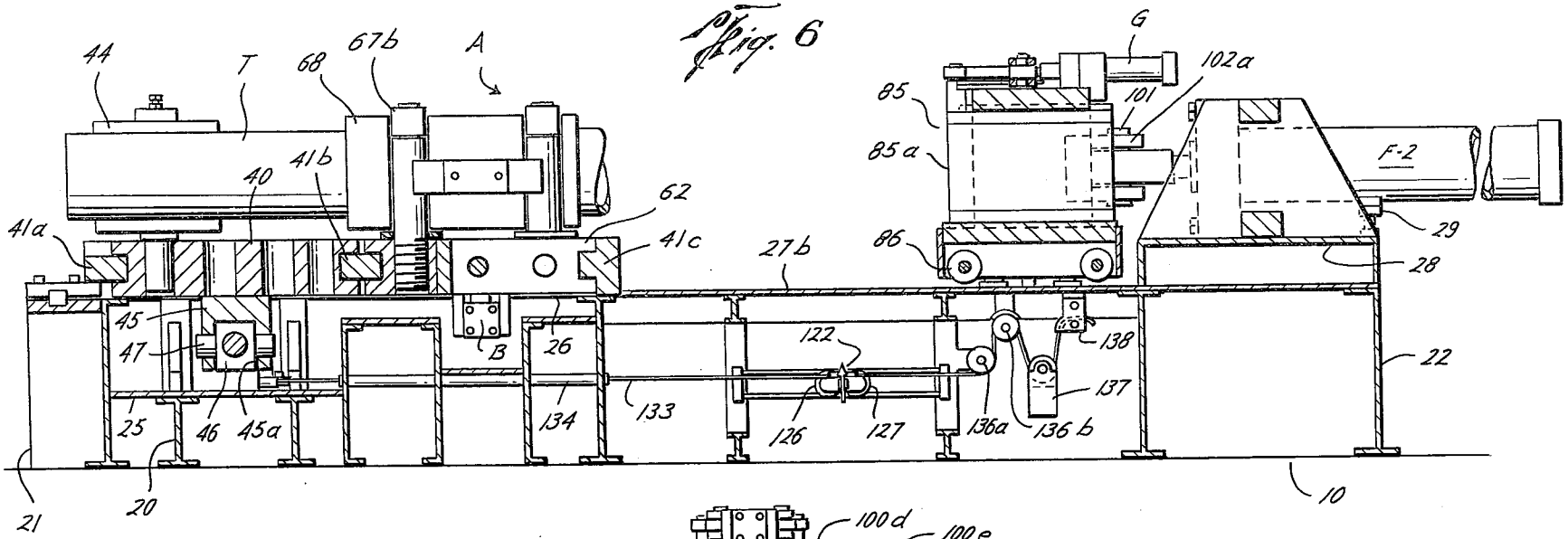
FIG. 6 is a side view partly in section of the bending apparatus.
Figure 7:
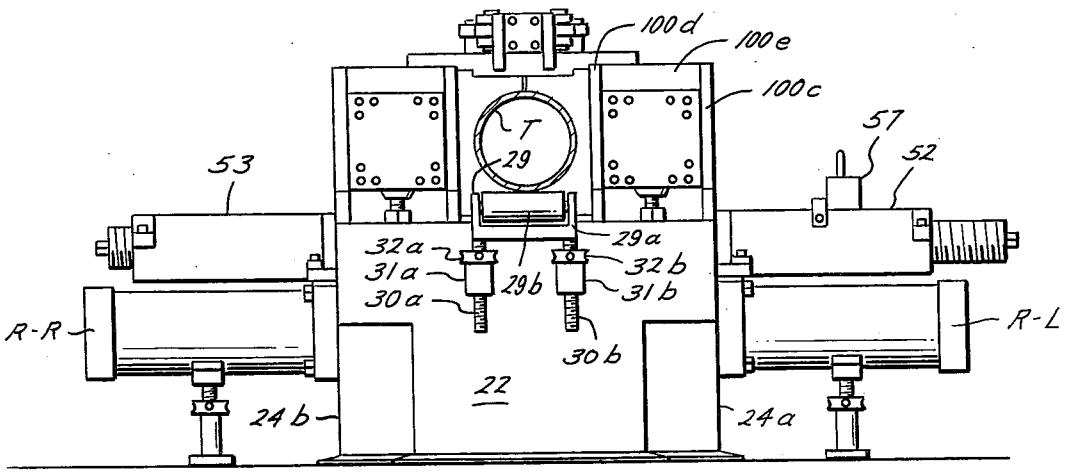
FIG. 7 is a rear view of the bending apparatus.
Figure 10:
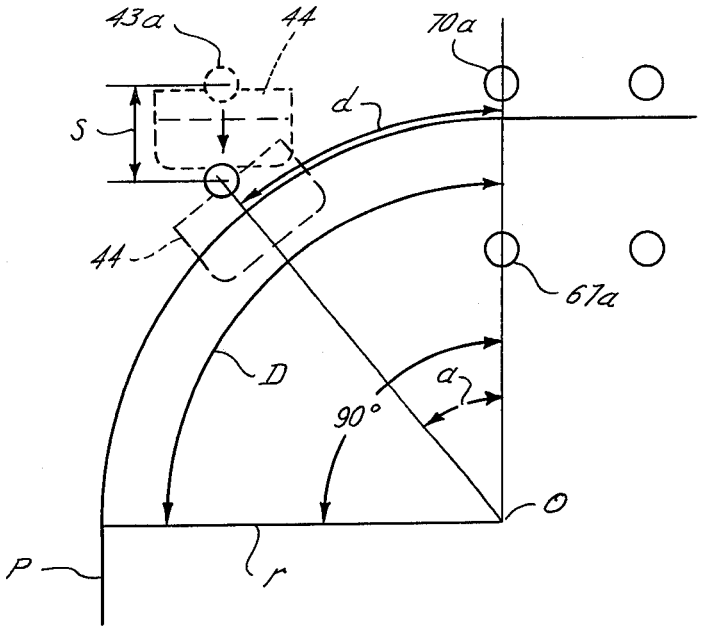
FIG. 10 is a schematic view of the bending path of a tubular member for calculating movement of the radial shoe and of the carriage-mounted gripping device during a first phase of the bending cycle.
Figure 11:
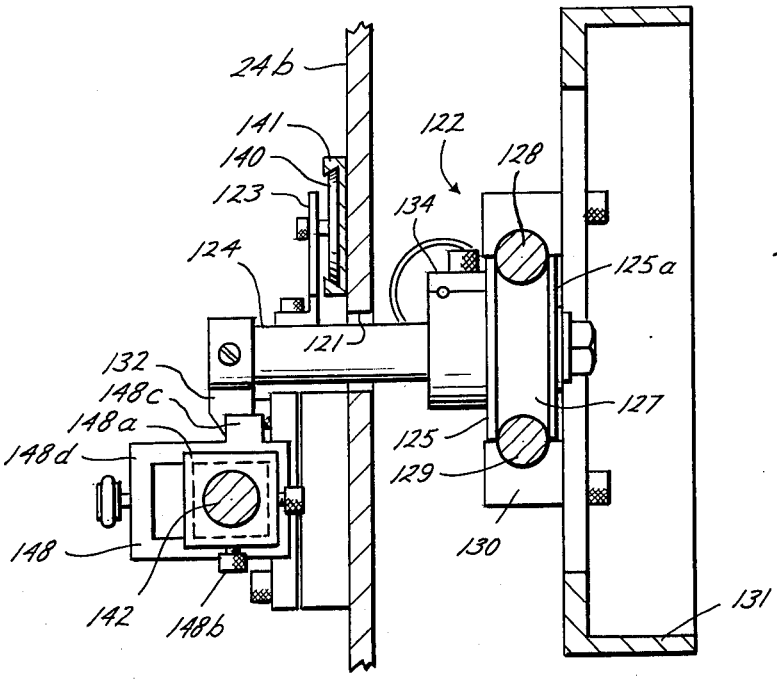
FIG. 11 is a sectional view of the radius indicator for the radial scale illustrated in the side view of FIG. 2.
Figure 12:
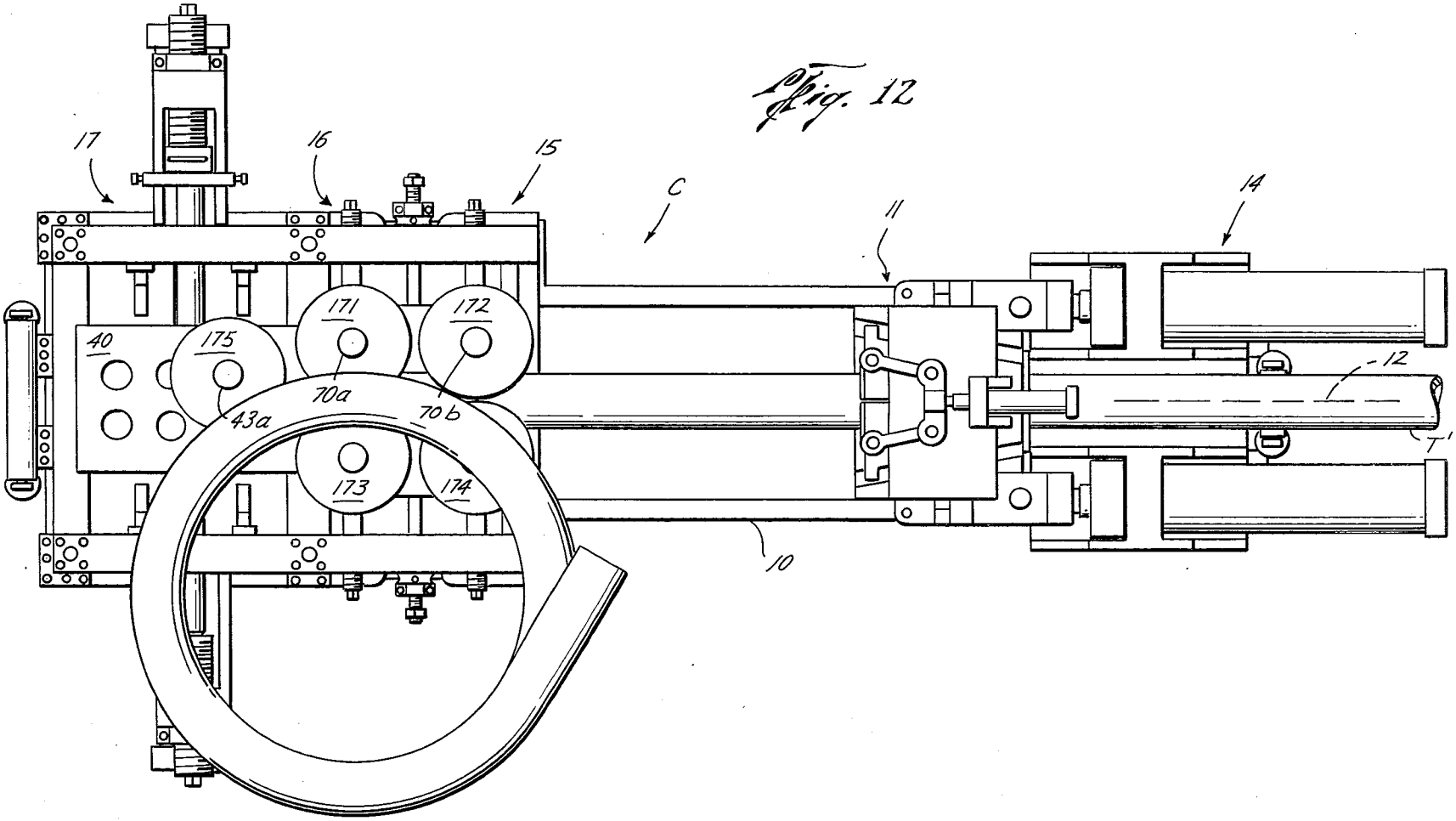
FIG. 12 is a top view of a coiling apparatus utilizing rollers for coiling thin-walled tubular members into a helical or coil configuration.

Referring to the drawings, the letter A refers to the bending apparatus of FIGS. 1–11 and the letter C refers to the coiling apparatus of FIG. 12. The bending apparatus A of FIGS. 1–11 is designed to bend hollow tubular member T such as pipe, thin-walled tubing or the like in a uniform radius of curvature *r*. The bending apparatus A basically includes a frame 10 having mounted thereon a gripping means 11 which is moved longitudinally along axis 12 in the direction of arrow 12*a* by a feed or advance means 14. Bending means generally designated by the number 15 include a bending die assembly 16 and a radius setting assembly 17 which are adapted to receive and bend the tubular member of pipe T as the tubular member is fed through the apparatus A by means of the gripping means 11 and feed means 14. Power control means 18, schematically illustrated in FIG. 5, are provided for controlling the movement of the gripping means 11, feed means 14, bending die assembly 16 and radial setting assembly 17 including providing for initially synchronized movement of the radial setting assembly 17 and the gripping means 11 and feed means 14, and thus of a tubular member or pipe T being fed through the apparatus, during a first phase of a bending cycle. Throughout this description, the bending cycle will be referred to as being "two-phase". It is within the scope of this art to utilize the invention here in a single phase bending cycle.

The frame 10 for the bending apparatus A may take any suitable configuration so long as it provides the necessary support. Referring to FIGS. 1–4 and 6–7 in particular, the frame 10 is provided by a series of channel members 20 of varying heights which extend transversely to the longitudinal axis 12 of the apparatus A. The channel members 20 support a front end panel member 21 and a rear end panel member 22 which are joined to side panel members 23*a* and 23*b* and 24*a* and 24*b*. The panel members 21–24 may be joined by bolting, welding or other connection means, all of which is well known in the art. The plurality of side channel members 20 support a lower platform 25, an upper platform 26, track members 27*a* and 27*b* and a rear platform 28.

A rear end roller assembly 29 is adapted to receive and rollingly support the tubular member T. The roller assembly 29 includes a U-shaped bracket 29*a* which supports the roller 29*b* therein. The bracket 29*a* is attached to threaded rods 30*a* and 30*b* which are supported in circular support brackets 31*a* and 31*b*, respectively. Set-screw controlled nuts 32*a* and 32*b* are threadedly mounted onto the rods 30*a* and 30*b* for adjusting the height of the roller 29*b*. A front end roller assembly 30 is mounted onto the front wall or panel member 21 for supporting a tubular member T which is being fed through the apparatus A in the reverse direction.

Radius Setting Assembly 17

The radius setting assembly 17 is provided for engaging the tubular member T and cooperating with the bending die assembly 16 to bend the tubular member T to the desired radius of curvature *r*. The radius setting assembly 17 includes a radius block 40 mounted on slides 41*a* and 41*b* extending transversely across the platform 26. The slides 41*a* and 41*b* are fastened to the platform by longitudinally extending frame members 42*a* and 42*b*. The radius setting block 40 has transversely extending side recesses which receive the slides 41*a* and 41*b* so that the block 40 is mounted for slidable movement transversely of the apparatus A. The radius setting block 40 has a plurality of openings 40*a* which extend vertically through the block for receiving the radial shoe assembly 43.

The radial shoe assembly 43 includes a shaft 43*a* which is adapted to fit within any of the openings 40*a* and extend vertically upwardly therefrom. The shaft 43*a* may be fastened within the openings 40*a* by any suitable means such as a threaded connection or otherwise. Of course, it is noted that one of the openings 40*a* is of a smaller size than the other openings. The size of the shaft 43*a* will, of course, conform to the size of the opening. A cap 43*b* is adapted to mount over the shaft 43*a*. The cap 43*b* has a radial shoe 44 welded or otherwise connected thereto. The radial shoe 44 has a semicircular recess 44*a* having a curved axis is viewed from the top (FIG. 1) for receiving the tubular member T as it is fed through the apparatus A. The cap 43*b* serves to mount the radial shoe 44 for pivotal movement with respect to the shaft 43*a*.

The radial block 40 has a lower depending block portion 45 welded or otherwise attached to the underside thereof. The block portion 45 extends through a suitably sized opening in the support platform 26. The block portion 45 has a U-shaped recess 45*a* for receiving drive block 46. The drive block 46 is mounted within the recess 45*a* by means of pins 47 which are held in position by snap rings or the like. The drive block 46 forms part of the power control means 18 of FIG. 5.

The power control means 18 for positioning the radial block 40 and radial shoe 44 mounted therewith include a pair of fluid-actuated cylinder assemblies R–L (radius setting from left) and R—R (radius setting from right). The fluid-actuated power cylinder assembly R–L is operated by hydraulic fluid and includes a hydraulic cylinder 48*a* having mounted therein for slidable, sealable movement a piston and rod 48*b*. The rod 48*b* is attached to the driving block 46 by any suitable means. Similarly, the fluid-actuated power cylinder assembly R—R is hydraulically actuated and includes a hydraulic cylinder 49*a* having mounted therein a piston and rod 49*b*, which rod is attached to the driving block 46. The hydraulic cylinders 48*a* and 49*a* are mounted in and extend outwardly from frame side panels 23*a* and 23*b*, respectively. The hydraulic cylinders 48*a* and 49*a* are held in horizontal positions by adjustable stands 50*a* and 50*b* illustrated in FIG. 3. The application of hydraulic fluid under pressure to the fluid-actuated power cylinder assemblies R–L and R—R will be described later with respect to the entire power control means 18. For the purposes of immediate description, it will be said that the purpose of the dual fluid-actuated power cylinder assemblies is to move the radial shoe 44 between an initial position on either the left or right side and a radius applying position. In the initial position, the radial shoe 44 engages a straight tubular member T which is about to be bent. The cylinder assemblies R—R and R–L are provided with fluid power by the control means 18 to move the radial shoe 44 from the initial position to the radius applying position illustrated in FIG. 1. During such movement, the radial shoe 44 actually bends to the tubular member T as the tubular member is fed through the apparatus A by the feed means 14 and gripping means 11, to be described in detail hereinafter. The cylinder assemblies R—R and R–L move the radial shoe 44 to a predetermined radius setting position during a first phase of the bending cycle. As will be described hereinafter, the power control means 18 operates to synchronize the movement of the radial shoe 44, by means of the cylinder assemblies R—R and R–L, with the movement of the gripping means 11 as controlled by the feed or advance means 14.

Lock support assemblies 52 and 53 are mounted on the left side and right side, respectively, of the apparatus A for supporting and maintaining the radial shoe in a radius setting position. The structure of the lock support assemblies 52 and 53 is identical except for position and thus the same numbers and letter will be used to describe the same parts. FIGS. 9A–9C illustrate the left side lock support assembly 52. The left side lock support assembly 52 is provided to lock, support and maintain the radius shoe 44 in a radius setting position for applying a radius and bend from the left toward the right, which bend is illustrated in the drawings. The lock support assembly 52 includes a semicircular support arm 52*a* which is bolted under the frame member 42*a* and extends transversely outwardly therefrom in alignment with the above the cylinder assembly R–L. The support arm 52*a* terminates in a circular portion having a threaded bore 53*a* which threadedly mounts a hollow sleeve 54 therein. The hollow sleeve 54 terminates in a nut 54*a* for receiving a tool for rotating the sleeve. A semi-circular clamp 55 held in place by setscrews 55*a* may be mounted over the sleeve 54 at the end of the support arm 52*a* for preventing rotation of the sleeve.

A lock shaft 56 is mounted in a recess 40*b* in the radial block 40 by any suitable means such as a pin and extends transversely outwardly therefrom in alignment with the bore of the hollow sleeve 54. Referring to FIGS. 9A–9C, the radial block 40 is illustrated in FIG. 9A in an initial position. In the initial position, the lock shaft 56 extends into the hollow sleeve 54. Movement of the radial block 40 by means of cylinder assemblies R—R and R–L moves the lock shaft 56 out of the sleeve 54. The length of the lock shaft 56 is designed such that the end portion 56*a* will be spaced from the hollow sleeve 54 when the radial shoe is in a radius setting position. As the radial block 40 is moved inwardly from left to right to the radius applying position, the end portion 56*a* of the lock shaft 56 clears the bore of the sleeve 54 and a spacer block 57 falls into the space therebetween. The final distance between shaft end 56*a* and sleeve 54 is adjusted by adjusting sleeve 54 in arm 52*a* so that the spacer block 57 will fall in the space therebetween at a predesignated point in order to block off the entrance to the sleeve 54 and cooperate with the lock shaft to support the radial shoe 44 during bending. A ring 59 may be mounted by means of set screws (FIG. 4) over the support arm 52*a* for holding the spacer block 57 in position as the lock shaft slides underneath the spacer block. As the radius block 40 and lock shaft 56 are moved transversely inwardly to the desired radius setting position, the spacer block rides on top of the lock shaft 56 and drops in position just as the radius block 40 attains the desired position. The sleeve 54 may be rotated within the support arm 52*a* to adjust the position at which the spacer block 57 drops into place. After the sleeve 54 is properly positioned, the clamp 55 is set so that further rotation of the sleeve 54 will not take place. The purpose of the locking assemblies 52 and 53 are to provide separate and additional support against the resistant forces exerted against the radial shoe 44. In this manner, the hydraulic system for the cylinder assemblies R–L and R–R is not overly taxed by the bending forces applied against the radial shoe.

Bending Die Assembly 16

The bending die assembly 16 is positioned to receive the tubular member T and apply the initial bend to the tubular member prior to engagement of the tubular member with the radial shoe 44. Referring to FIGS. 1–8B, the bending die assembly 16 includes first and second bending die blocks 61 and 62 which are mounted onto the frame platform 26 for slidable movement inwardly toward each other and outwardly away from each other. The bending die blocks 61 and 62 are slidably mounted onto the central slideway 41*b* and onto end slideway 41*c*. The slideway 41*b* is mounted in a transverse recess within both slide blocks 61 and 62 and serves to mount both slide blocks 61 and 62 for slidable, lateral movement (slide block 41*b* has already been described as mounting radial block 40 for slidable, transverse movement). The slideway 40*c*, which is mounted in place by frame members 42*a* and 42*b*, slidably mount the other side of the bending die blocks 61 and 62 for such slidable, transverse movement. Guide pins 63*a* and 63*b* are fixedly mounted in slide block 62 and extend into guide bores in slide block 61 for helping to maintain the slide blocks 61 and 62 in alignment during such lateral movement inwardly and outwardly with respect to each other. A fluid-actuated power cylinder assembly B is mounted onto the bottoms of the bending die blocks 61 and 62 for moving the die blocks transversely. The cylinder assembly B is operated by hydraulic fluid as supplied by the power control means 18 of FIG. 5. The cylinder assembly B includes a hydraulic cylinder 64*a* mounted on supports 65*a* and 65*b* which are welded onto the bottom of the bending die block 61. The cylinder 64*a* is a typical hydraulic, double-acting cylinder which mounts a piston and rod combination 64*b* for slidable, sealable movement. The piston and rod combination 64*b* is mounted to the bottom of the bending die block 62 by supports 66*a* and 66*b* and pin 66*c*.

The cylinder assembly B mounts the bending die blocks 61 and 62 for simultaneous, inward movement toward each other to a central, operating position and away from each other to an initial, non-engaging position.

The bending die block 62 has mounted therein mounting pins 67*a* and 67*b*. Bending die 68 is mounted against the mounting pins 67*a* and 67*b* and is held in position by a bracket 69 which engages the pins 67*a* and 67*b* and is connected by bolts to the outside of the die 68. The pins 67*a* and 67*b* are threadedly mounted in the die block 62 by counterclockwise threads so that the pins will not loosen when mounting rollers rather than the die block 68 and rollingly engaging a tubular member T. The use of rollers will be described with respect to FIG. 12.

Mounting pins 70*a* and 70*b* are mounted by clockwise threading into openings in the bending die block 61 and support a die 71 by an outside bracket 69. The dies 68 and 71 have alignable, semi-circular recesses 68*a* and 71*a* of appropriate diameter to receive the tubular member T. Of course, the actual size of the semi-circular recesses within the dies 68 and 71 will depend upon the size of the tubular member T being bent. Such bending dies as 68 and 71 are well known in the art and at least one of the dies such as die 68 will include a bending portion at the front end thereof for cooperating with the radial shoe 44 to bend the member T to a desired radius *r*.

In operation and use, one of the dies such as the die 71 as supported on bending die block 61 is first locked in a central position and then the other die 68 on block 62 is then moved inwardly and outwardly with respect to the fixed die for the purpose of receiving and releasing tubular member T for bending. The locking of the dies 68 and 71 in position is accomplished by means of locking assemblies 74 and 75, which are identical except for being positioned on opposite sides to provide locking for the oppositely positioned die blocks. Since the locking assemblies 74 and 75 are identical except for position, only the locking assembly 74 will be described in detail, it being understood that the same description will apply to the locking assembly 75 except for location.

The locking assembly 74 includes a central locking rod 76 which is mounted in the die block 61 by suitable means such as a pin and extends outwardly therefrom. The locking rod 76 is threaded at its outside end and has mounted thereon a threaded, clamp-nut 77 which may be loosened and rotated inwardly and outwardly on the threads of the locking rod 76 and thereafter be tightened to be held in position. The locking rod 76 extends through a suitable opening in the side of the frame and clamp-nut 77 is sized such that it will not pass through such opening. In this manner, the clamp-nut 77 may be positioned such that it will engage the frame at a predesignated point as the die block 61 is moved inwardly and thus prevent further inward movement of the die block 61.

The locking assembly 74 further includes outside locking devices 78 positioned on either side of the central locking rod 76. The outside locking devices 78 include a hollow sleeve member **78*a* threadedly mounted into the frame below the frame member 42*b*. Threaded mounting of the hollow sleeve 78*a* serves to make the position of the sleeve adjustable. The outside of the die block 61 includes circular recesses 61*a* which align with the adjustable sleeves 78*a* and actuatlly receive the sleeves when the die block 61 (and thus radial shoe 44) is in an initial, outside position. When the die block 61 is moved to an inside, operating position, the position of the sleeves 78*a* is adjusted such that spacer elements 79 may be positioned between the sleeves 78*a* and in engagement with the die block 61 for cooperating with the sleeves 78*a* to support the die 71 mounted on die block 61 in its desired location. The spacer elements 79 also serve to allow one of the dies such as the die 68 to be easily movable with respect to the other die 71 for the purpose of removing and placing into the dies 71 and 68** a tubular member T to be bent.

The bending die assembly 16 is basically set in the following manner. The power control means 18 is operated to actuate the hydraulic cylinder assembly B to move the dies 68 and 71 from an initial, outer position to a central, inward position where the dies meet and combine to form a circular passageway to receive and mount a tubular member T for movement therethrough. With the dies 68 and 71 in a central position, the position of the central locking rod 76 is fixed by rotating the clamp-nut 77 to a position against the frame side. In this manner, further inward movement of the die 71 is prevented. The die 71 is then locked against outer movement by adjusting the position of the locking sleeves **78*a* such that the spacer elements 79 are inserted between the sleeves 78*a* and the die block 61. The spacer elements 79 include a central portion 79*a* which is a support resting on the top of block 61. The die block recesses 61*a* provide space for repositioning locking device 78 by receiving sleeves 78*a*. These outside locking devices 78 thus serve to lock the die 71 and die block 61** against movement outwardly.

After the die 71 has been locked in the central position, the central locking rod 76 for the locking assembly 75 is set so that further inward movement of the die 68 past the central position is prevented. The outside locking devices 78 for the locking assembly 75 are then set such that outward movement of the die block 68 is prevented. Whenever it is desirable to receive a tubular member for bending, the spacer elements 79 of the locking assembly 75 are removed and the hydraulic cylinder assembly B is actuated to move the die block 62 and thus die 68 outwardly away from the die 71. A tubular member T may then be removed from between the dies 68 and 71 and another tubular member may be inserted therein. The hydraulic cylinder assembly B is then actuated to move the die 68 back to the central, operating position adjacent and mating with the die 71. The spacer elements 79 are replaced and the entire assembly is ready to support and apply bending to a tubular member T as it is fed therethrough. It is noted that the independent mounting of the hydraulic cylinder assembly B free of the frame 10 allows the dies 68 and 71 to move simultaneously inwardly and outwardly initially and, after one of the dies such as 71 is locked in position, allows relative movement of the other die 68.

Figure 8B:
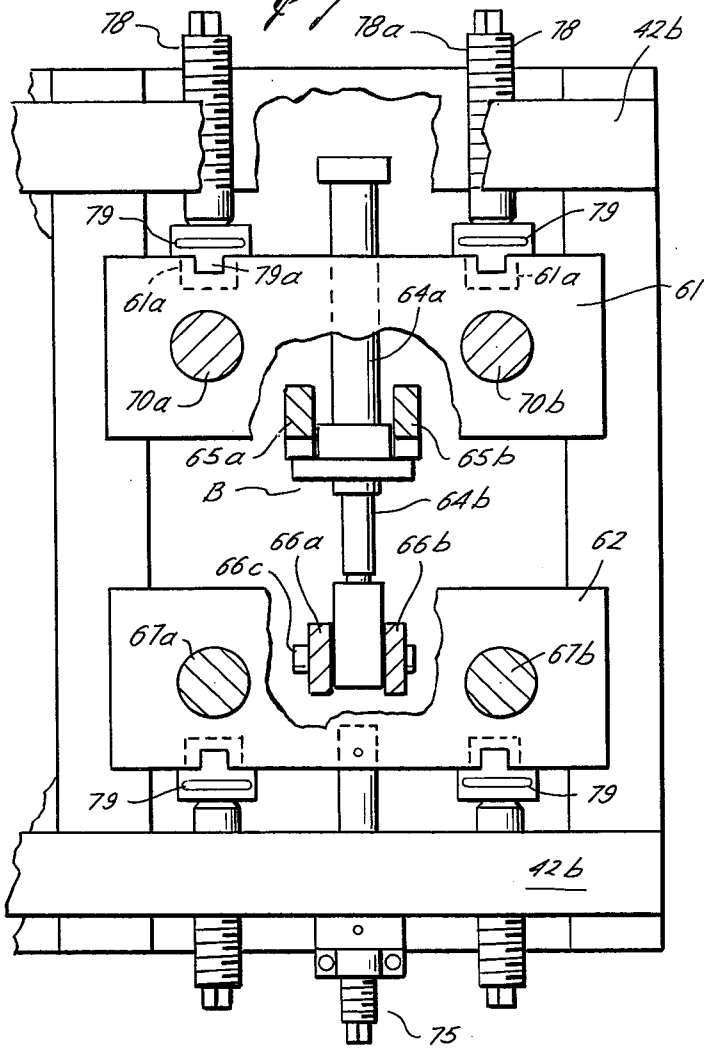
FIG. 8B is a top view partly in section of the bending die assembly of either FIGS. 1–7 or of FIG. 8A.
Figure 8A:
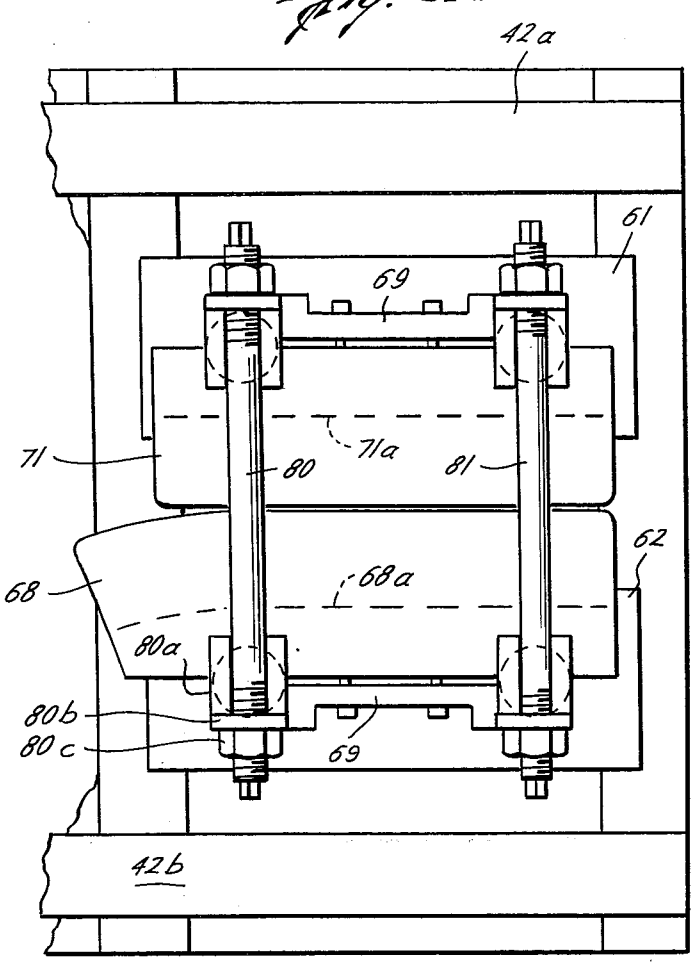
FIG. 8A is a top view of a modification of the bending die assembly of the bending apparatus.

FIG. 8A discloses a modification wherein tie rods 80 and 81 are used to clamp together the dies 68 and 71 in the central, operating position. In the embodiment heretofore described for the bending die assemblies, each pin such as pin **67*a* supporting die 68 has a cap 67*b* mounted at the top thereof. Each of the caps such as 67*b* may be removed and replaced with a block such as 80*a* which fits over the top end portion of the pin 67*a*. The block 80*a* has a top semicylindrical recess which receives one end of the tie rod 80, which is held in position by plate 80*b* and bolt 80*c*. Each of the other pins 67*b*, 70*a* and 70*b* have similar blocks mounted thereon to complete the mounting of the tie rod 80 and to mount the tie rod 81**.

Gripping Means 11 and Feed Means 14

The gripping means 11 is mounted onto the tracks **27*a* and 27*b* of the frame 10 for movement along the longitudinally axis 12 of the apparatus A. The gripping means 11 is formed by a carriage 85 which is basically a rectangular housing open at front end 85*a* thereof. Two sets of wheels 86 mounted on either side of the bottom of the housing 85*a* for engagement with the tracks 27*a* and 27*b* to actually mount the carriage 85 for movement. The carriage 85 is hollow inside and includes a basically rectangular space which mounts wedge-like, gripping members 87*a* and b btherein. Each of the gripping members 87*a* and 87*b* have a semi-circular recess on the inside thereof to receive and grip the tubular member T. The gripping members 87*a* and 87*b* are mounted within the housing 85*a* of the carriage 85 for movement between a central, gripping position and an outer, released position for alternately gripping and releasing the tubular member T as desired. The mounting of the wedge-shaped members 87***a* and 87*b* for such gripping and releasing movement is accomplished by mounting the elements 87*a* and 87*b* in inclined grooves 88*a* and 88*b* as illustrated in scored lines in FIGS. 1, 4 and 6. The gripping elements 87*a* and 87*b* each include an outside, inclined surface adapted to engage the grooves 88*a* and 88*b* within the housing 85*a* such that the gripping elements are actually wedged together as moved in the direction of arrow 90*a* a cylinder assembly G and are forced apart when moved in the direction of arrow 90*b*.

The fluid-powered cylinder assembly G includes a hydraulic cylinder 92 mounted on suitable supports onto the carriage housing 85*a* and a piston and rod combination 93 is mounted in the top of the housing 85*a* and terminates in a yoke 96. The yoke 96 is connected pivotally to the gripping elements 87*a* and 87*b* by arms 97*a* and 97*b*, respectively. In this manner, expansion of the cylinder assembly G moves the gripping elements 87*a* and 87*b* in the direction of arrow 90*b* outwardly of the housing 85*a*. Movement of the elements 87*a* and 87*b* in the direction of arrow 90*b* moves the elements 87*a* and 87*b* outwardly with respect to each thereby releasing the tubular member T from gripping engagement. Conversely, contraction of the cylinder assembly G will cause the gripping elements 87*a* and 87*b* to be pulled inwardly into the housing 85*a* into contraction and gripping engagement with the tubular member T.

The feed or advance means 14 is operatively connected to the carriage 85 for moving the carriage along the tracks 27*a* and 27*b* between an initial and a final position in order to feed or push the tubular member T through the dies 68 and 71 and into radius setting engagement with the radial shoe 44.

The feed or advance means 14 is provided for actually moving the carriage 85 between the initial and final feeding positions. The feed or advance means 14 includes first and second fluid-actuating cylinder assemblies F-1 and F-2 mounted onto the frame 10 and connected to the rear end of the carriage 85 for propelling the carriage forwardly and rearwardly of the apparatus A. The cylinder assemblies F-1 and F-2 are hydraulically operated by the power control means 18 illustrated in FIG. 5, which will be described in greater detail hereinafter.

The cylinder assembly F-1 includes a cylinder 100*a* mounted in frame support 100*b*. The frame support 100*b* may include vertically extending panels or supports 100*c* and 100*d* which are interconnected and supported by member 100*e*. A piston and rod combination 100*f* is mounted in a known manner within the cylinder 100*a* and extends into a pin-type connection 101 with carriage supports 102*a*. The cylinder assembly F-2 is identical except that it is positioned on frame side 24*b* and is attached to the other side of the carriage. Similar types supports as 102*a* are mounted onto the front end of the carriage 85 for connecting the opposite side of the carriage to the cylinder assemblies F-1 and F-2. This is desirable whenever it is desired to actually feed tubular members T from the opposite direction. Thus, the carriage 85 through supports 102*a* is reversible and may be operated to actually feed tubular members from left to right across the drawing such as in FIG. 1, rather than from right to left as described otherwise throughout this application.

Power Control Means 18

The power control means 18 is illustrated schematically in FIG. 5. Each of the fluid-actuated cylinders for the radius shoe 44, the bending dies 68 and 71, the gripping elements 87*a* and 87*b* and for movement of the carriage 85 are illustrated schematically. It should be noted that the position of the hydraulic cylinder assembly B which moves the bending dies 68 and 71 is actually illustrated as being mounted oppositely from the mounting position previously described. This change is unimportant and merely indicates that the invention herein remains the same notwithstanding the actual orientation of the cylinder assembly B.

The power control means 18 includes a console 110 which is connected by a suitable electrical cable 111 to an electric-valve control circuit 112 actually mounted within the frame 10. The console 110 may be mounted onto the frame 10 or may be located at a point remote from the frame such as on a pedestal or the like. The electric-valve control 112 is illustrated schematically by diagrammatic boxes 1–7. Each of the boxes represents a valve which is electrically operated such as through a solenoid actuated by the console 110. In addition, an override or automatically operating valve A is illustrated in direct connection to valve 5. Each of the valves control the passage of hydraulic fluid under pressure from pump 114 to various control lines which run to the hydraulic cylinders R–L, R—R, B, G, F-1 and F-2 (a mandrel M hydraulic cylinder assembly is also illustrated, the use of a mandrel being well known in the art and not forming part of this invention). Each of the valves 1–7 has two lines extending from it, one labeled X and the other labeled"O". For left to right bending, the X lines direct hydraulic fluid under pressure from the pump 114 to the various hydraulic cylinders while the O lines provide a return path. The hydraulic lines will not otherwise be identified except as being paths for flow from particular valves, either directing pressure to one or more cylinders or providing a return path for pressurized fluid.

The following charts define the relationship between the various valves 1–7 and the valve A and the various hydraulic cylinders actuated by these valves:

CHART I

| Valve | Cylinder Assembly |
|---|---|
| $1_x$ | R–L bend from left to right |
| | R–R |
| $2_x$ | B |
| $3_x$ | G |
| $4_x$ | F-1, F-2 |
| $5_x$ | G, F-1, F-2 |
| $6_x$ | G, F-1, F-2, R–L, R–R |

CHART II

| Valve | R–R & R–L Radius Shoe | B Bending Dies | G Gripper | F-1 & F-2 Feed |
|---|---|---|---|---|
| 1 | X | | | |
| 2 | | X | | |
| 3 | | | X | |
| 4 | | | | X |
| 5 | | | X | X |
| AU-automation uses switch 5 on reiteration | | | | |
| $6_x$ (synchronize) (return flow through 8&9) | X | | X | X |

There are several additional valves which are located actually in the hydraulic lines. These valves include solenoid valves SV-1 through SV-5 which are activated by activation of particular main valves 1–7. Further, flow control valves numbered 8 and 9 are provided for controlling the rate of flow of hydraulic fluid outwardly from the radius setting cylinder assemblies R–L and R—R and the feed cylinder assemblies F-1 and F-2, respectively. The flow control valves 8 and 9 may be any suitable flow control type valve. For example, the flow control valves 8 and 9 may be a variety of flow control valves presently manufactured by Racine Hydraulics, Inc. of Racine, Wisconsin.

The purpose of the entire power control means 18 is to control the movement of the radius shoe 44, dies 71 and 68, gripper elements 87*a* and 87*b* and the carriage 85 therefor. The power control means 18 further includes means for synchronizing actuation and movement of the cylinders R–L, R—R, F-1 and F-2 in order to synchronize the movement of the radial shoe 44 with the movement of the carriage 85 along frame tracks 27*a* and 27*b*. It has been determined that it is particularly important and crucial that movement of the radius setting shoe 44 and movement of the tubular member T, as controlled by the gripper elements 87*a* and 87*b* and carriage 85, be coordinated so that the radius setting shoe 44 and tubular member will reach predesignated destinations for producing a predesignated radius at the same time so that the bend produced during movement of both the radius shoe 44 and of the carriage 85 is uniform.

Referring to the Charts I and II, the various cylinder assemblies are actuated in the following manner. Movement of valve 1 to the $1_X$ position operates simultaneously radius setting cylinder assemblies R–L and R—R to move the radial shoe 44 from left to right in the direction of arrow 115, which direction is transverse to the longitudinal axis 12 of the apparatus A. Valve 1 is closed by manual operation of a suitable electrical switch on console 110. Operation of valve 1 in the $1_O$ direction wherein fluid under pressure is applied through the O line will cause the radial shoe to be moved from right to left in the direction opposite to direction 115. Activation of valve 2 along path $2_X$ will operate to move the bending dies 68 and 71 outwardly with respect to each other and the application of fluid pressure along path $2_O$ will operate the cylinder assembly B to move the dies 68 and 71 toward a central, operating position.

Operation of valve 3 along path $3_X$ moves the gripping elements 87*a* and 87*b* outwardly of the housing 85*a* and thus out of contact with a tubular member T. Conversely, operation or application of fluid pressure along path $3_O$ will cause a gripping of the tubular member T. Application of fluid pressure through valve 4 in the direction illustrated as $4_X$ will push or feed the carriage 85 and any tubular member T gripped thereby forwardly toward the bending dies 68 and 71 and radial shoe 44. Application of fluid pressure along path $4_O$ will cause the carriage 85*a* to move rearwardly and return to its initial position for further use.

Application of valve $5_X$ causes simultaneous operation of the cylinder G and the cylinders F-1 and F-2 to close the gripping elements 87*a* and 87*b* about the tubular member T and to feed the carriage 85 and thus the tubular member T forwardly towards the bending dies 68 and 71. When valve 5 is utilized along the $5_X$ paths, solenoid valves SV 1 and SV 2 are closed and solenoid valves SV 3–5 are open.

The application of fluid pressure along valve path $5_O$ will move the gripping elements 87*a* and 87*b* to a released position and actuate cylinder assemblies F-1 and F-2 to return the carriage 85 and gripping elements 87*a* and 87*b* mounted therein to its initial position.

The valve AU is an automatic valve which automatically applies fluid pressure to alternating paths of valve 5 in order to automatically cause the elements 87*a* and 87*b* to grip the tubular member and move the tubular member forward, release the tubular member and return to its initial position and thereafter to again grip and move forward. This thus is an automatic operation which will continue until shut off as later described.

Actuation of switch $6_X$ causes simultaneous and coordinated movement of the radial shoe 44 (controlled by cylinder assemblies R–L and R—R) and the tubular member T as controlled by carriage-mounted gripping elements 87*a* and 87*b* (cylinder assembly G) as motivated by feed cylinder assemblies F-1 and F-2. It is noted that return flow along the paths labeled $6_O$ must pass through the flow control valves 8 and 9, which are set to control the rate of flow therethrough and thus the actual rate of movement of the piston and rod combinations for the cylinder assemblies R–L, R—R and F-1 and F-2. In this manner, the relative speed of the radial shoe 44 and of the tubular member T, as moved by the carriage-mounted gripper elements 87*a* and 87*b* may be synchronized.

The valve 7 is provided for operation of the mandrel M, which is not otherwise shown since it does not form part of this invention. It is sufficient to say that use of the mandrel M is well known in the art.

Scale and Travel Limit Means

A radial distance scale and limit means 120 (FIG. 2) is mounted onto and within the frame 10 for setting and limiting the transverse distance moved by the radial shoe 44 between an initial and a predesignated radius applying position. The frame side 24*b* has a horizontal extending slot 121 therein for receiving indicator 122. The indicator 122 includes an arrow at 123 which is attached to limit arm 124 extending outwardly of frame side 24*b* from a trolley 125. The trolley 125 includes a basic body portion 125*a* which mounts wheels 126 and 127 on upper and lower track members 128 and 129. The upper and lower track members 128 and 129 are mounted in a support 130 which is connected to an internal frame member 131. The tracks 128 and 129 extend horizontally in alignment with the opening 121 in order to mount the wheels 126 and 127 and thus the trolley 125 for movement along the opening 121. Arm 124 extends outwardly through the frame side opening 121 and terminates in a depending catch 132. The trolley 125 is mounted for longitudinal movement along the track members 128 and 129 in response to transverse movement of the radial shoe 44. A cable 133 is clamped in a holder 134 on the trolley body 125*a*. The cable 133 extends forwardly through a mounting tube 134 about a pulley 135 (FIG. 3) and into attachment by clamp 136 to lower block portion 45. The cable 133 extends rearwardly through permanently mounted pulleys 136*a* and 136*b* and through weighted pulley 137 into a fixed clamped connection at 138. The purpose of the weighted pulley 137 is to maintain the cable 133 taut even during movement of the radial shoe from left to right. In this manner, the exact transverse distance moved by the radial shoe 44 may be measured on scale 140 mounted in scale track 141, which is positioned above side frame slot 121.

A limit shaft 142 is mounted by sleeves 143*a* and 143*b* onto frame side 24*b* for horizontal movement.

The limit shaft is biased by springs 144*a* and 144*b*, as suitably held by shaft-mounted clamps, such that the shaft 142 will be returned to an initial position after movement in either direction. A semi-circular valve actuator 146 is mounted onto the rear end of the limit shaft 142 in engagement with lever 147 for valve 6, which is, of course, illustrated schematically in FIG. 5. Movement of the limit shaft 142 either forwardly or rearwardly by limit catch 132 will rotate in either direction the valve lever 146 thereby shutting off the valve 6. The catch 132 of the indicator 122 is positioned to engage an upwardly extending limit tab 148, which is adjustably mounted by means of a set screw or the like onto the shaft 142. The tab 148 is positioned to be engaged by the catch 132 of the indicator 122 upon movement of the radial shoe 44 a predesignated distance from left to right. Engagement of the limit tab 148 by the catch 132 will move the shaft 142 rearwardly thereby rotating the levers 147 for valve 6 clockwise and shutting off further flow. Another tab 149 is positioned near the forward end of the shaft 142 for engagement by the catch 132 of the indicator 122 during movement of the radial shoe 44 from right to left for bending in that direction. A original position indicator 150 is mounted on the shaft 142 between the limit tabs 148 and 149 and is used to set the initial position of the radial shoe 44.

The actual structure of the limit tabs 148 and 149 mounted onto the shaft 142 is best illustrated in FIG. 11 where the limit tab 148 is illustrated in cross section. Both the limit tabs 148 and 149 are identical in structure and thus the following description will apply to both equally. The limit tab 148 includes a nut 148*a* having an opening therein, which nut is actually mounted for slidable movement along the shaft 142. The nut is held in position by set screws 148*b*. An upstanding stud or tab portion 148*c* is integrally formed on a slide 148*d* mounted on the nut portion 148*a*. The purpose of the slide 148*d* is to position the lug portion 148*c* either in alignment with the catch 132 on the indicator 122 or out of alignment therewith as desired.

A longitudinal distance scale and limit means 160 is mounted onto the frame side 24*b* for determining and controlling the amount of longitudinal travel of the tubular member T as gripped by the gripping elements 87*a* and 87*b*. A scale 161 is mounted onto the frame side 24*b* in alignment with a carriage position indicator 162. The carriage position indicator 162 includes a support 162*a* having side mounted wheels 162*b* for engaging the frame side 24*b* and stabilizing an indicator and limit element 163 which extends downwardly into a position in front of the scale 161. A limit shaft 164 is mounted by mounting sleeves 165 onto the frame side for horizontal movement. Confined spring elements 166 are positioned on either side of the righthand sleeve mounting 165 for returning the limit shaft 164 to an initial position. An initial position indicator 150 is mounted on the shaft 164 between shaft mounted limit arms 148 and 149. The shaft mounted limit tabs 148 and 149 are positioned to engage the depending carriage mounted limit element 163 in order to move the shaft horizontally and rotate lever 170 for valve 5 in order to shut off the valve.

Coiling Apparatus C

The coiling apparatus C of FIG. 12 is basically identical to the bending apparatus A of FIGS. 1–11. Therefore, only the structural differences between the two devices will be described. The coiling apparatus C is designed to receive straight tubing T′, which may be a thin-walled tubing, and bend such tubing into helical coils. The bending die assembly 16 is identical in the coiling apparatus C except that rollers 171–174 are mounted onto the mounting pins 70*a*, 70*b*, 67*a* and 68*a*, respectively. Each of the rollers includes a semi-circular recess adapted to receive the tubing T′. Bend is applied to the straight tubing T′ as it is moved through the rollers 171–174 by the feed means. This bending is accomplished by proper sizing of the rollers 171–174 as is known in the art. The radius setting assembly 17 is also identical to that of the bending apparatus A except that a roller 175 is mounted onto mounting pin 43 extending out of an opening in the radial block 40. During the coiling operation, the radius setting roller 175 is moved from an initial position to a radius setting position simultaneously with movement of the tubing T′, by means of gripping means 11 and advance means 14, to predesignated locations; thereafter, the gripping means 11 and advance means 14 are used to continue the feeding or pushing of the tubing T′ through the bending die assembly 16 and radius setting assembly 17. Since the operation of the coiling apparatus C and the bending apparatus A is virtually identical, only the operation of the bending apparatus A will be further described.

Operation and Use of the Bending Apparatus A

In explaining the setting and operation of the bending apparatus A, it will be assumed that the bend cycle for the tubular member T is in two parts or phases. In the first phase, the radial shoe 44 and the carriage 85, with elements 87*a* and 87*b* gripping the tubular member, are moved to predesignated position synchronously. This means that the carriage 85 and thus the tubular member T will be moved a longitudinal distance *d* in the same amount of time that the radius setting shoe 44 will be moved to a radius setting position, a distance herein defined as *s*. Thereafter, the tubular member will continue to be fed through the dies 68 and 71 and into bending engagement with the set radial shoe 44 for the purpose of completing the bend. The total movement of the tubular member by the carriage mounted gripping elements 87*a* and 87*b* as propelled by the cylinders F-1 and F-2, is defined as a distance D.

The first step is therefore to calculate the various settings and distances necessary to bend a tubular member T to a particular radius and angle. FIG. 10 represents schematically the distances which must be calculated in order to bend a tubular member T through a 90° bend.

Referring to FIG. 10, the initial position of the radial shoe 44 as compared with the initial position of the bending die pin 70*a* is illustrated. The initial parameters given will be the size of the tubular member T and the radius *r* to which the tubular member T is to be bent. Disregarding cold spring (the tendency of a pipe to return slightly towards its straight position) and the actual geometric calculations used, the following distances and angles are determined.

It is necessary to determine the final position of the radial shoe 44 in order to determine the distance of movement *s* of the radial shoe from the initial position to the radius setting position. This is basically done by determining the necessary path *p* of the outside wall of the tubular member T must follow in order to attain a particular bend. The distance *s* that the radial shoe moves from its initial to its radial setting position in engagement with *p* is geometrically determined as is the angle *a*. The angle *a* defines the angle from the point of initial bend by the bending dies 68 and 71 to the radius setting position of the shoe 44. After the angle *a* is determined, the distance *d* of the arc through which a point on the tubular member T will travel from the initial bending by bending dies 68 and 71 to the radius setting position of the shoe 44 is determined. This arc *d* represents the distance that the carriage 85 must travel forwardly with elements 87*a* and 87*b* gripping the tubular member. It is then necessary to determine the arc distance D, which is the distance of travel of the tubular member T through the full desired 90° bend.

Travel of the radius setting shoe 44 the distance *s* is coordinated with travel of the carriage mounted gripping elements 87*a* and 87*b* and thus of the tubular member T through the distance *d*. The radius setting shoe 44 is to travel the distance *s* in the same amount of time that the carriage mounted gripping elements move the tubular member a distance *d*. This synchronization of movement of the radial shoe 44 with initial movement of the gripped tubular member T through a distance *d* insures that a uniform radius will be applied to the tubular member T during this first bending phase. In the second bending phase, the cylinders F-1 and F-2 continue to move or feed the tubular member T forwardly for a total distance of D for a 90° bend.

In order to synchronize initial movement of the radial shoe 44 and initial longitudinal feed of the tubular member T, it is desirable that the flow control valves 8 and 9 be set to control the flow of pressurized fluid to the cylinders R–L, R—R, F-1 and F-2. This is accomplished by determining a travel ratio which is defined as *d/s*. This *d/s* ratio is set into the flow control valves 8 and 9 such that the values on the flow control valves will be represented by the value at the flow control valve 9 divided by the value on the flow control valve 8.

The distance *s* of radial movement of the shoe 44 is then set on the radial distance and scale control means 120 by moving limit tab 148 to a distance *s* on the shaft 142 away from original position indicator 150. At the same time, the distance *d* is at least temporarily marked onto the scale 161 of the longitudinal distance and limit means 160 and further the distance D is appropriately set. It may be necessary for the carriage 85 to be moved the full stroke and returned to make up a distance D. If necessary, then the initial stroke distance is subtracted from D to determine the setting of limit tab 149 or 150 on shaft 164.

After these settings have been made, it is possible to go through a series of steps known in the art to test and adjust the position to insure that the calculations are accurate. As previously mentioned, cold spring has not been taken into effect and may be taken into effect during such testing and even in the calculation of the values *s* and *d* if desired. During such testing, the individual movements of the various elements such as cylinders R–L and R—R and thus of the radius setting shoe 44 may be tested. During such testing, valves 1–4 will generally be utilized since these valves are capable of individually actuating various cylinder assemblies. Prior to actual operation, the radius shoe 44 is set for moving the distance *s* at the flow control ratio previously described. The radius shoe 44 is set for movement the distance *s* to the predesignated radius setting position by operation of the hydraulic cylinders R–L and R—R. During initial movement of the radius shoe 44 in a testing phase, the locking assembly 53 is set as previously described such that during actual operation, the spacer block 57 will automatically drop between the sleeve 54 and the shaft 56 to lock the shoe 44 in its final radius setting position. The bending dies 68 and 71 are set in the manner previously described for receiving and applying the initial bending to the particularly sized tubular member T. This is accomplished by setting the bending die 71 in a central, operating position and locking the bending die against movement inwardly or outwardly. The bending die 68 is then set in the central, operating position and is moved inwardly and outwardly with respect to the die 71 for the purposes of removing and receiving tubular members T.

After the radial distance *s* and the longitudinal feed distance D are both radially set into the distance and scale limit means 120 and 160 and actually tested, the bending apparatus A is ready to operate. Prior to placing in a tubular member T for actual bending, the radial shoe 44 is returned to its initial position and the bending die 68 is opened with respect to the bending die 71 to receive a tubular member T. The bending die 68 is then closed and locked by resetting of the spacers 79.

If the radial shoe 44 is not in contact with the tubular member at this point, it is moved into contact with the straight tubular member T. This is accomplished, of course, by operating the valve 1 along paths $1_X$.

Valve 6 is then actuated along paths $6_X$ to simultaneously operate cylinders R–L and R—R, B, G, F-1 and F-2 in order to simultaneously move the radial shoe 44 transversely inwardly in the direction of arrow 115 as the tubular member T is fed longitudinally forwardly through the bending dies 68 and 71. This combined longitudinal feeding and radius setting bending continues until the catch 132 of the radial distance and limit means 120 engages the limit tab 148 on shaft 142 and moves the shaft rearwardly to rotate lever 146 clockwise and shut off the valve 6. At this point, the carriage mounted indicator 163 is at the distance *d* point temporarily marked on the longitudinal scale 161. Thus, the radial shoe 44 and the carriage 85 have moved the predesignated distances *s* and *d*, respectively, to arrive at their respective predesignated positions at exactly the same time. During this first phase of the bending cycle, the radius setting shoe 44 gradually applies the radius to the moving tubular member during movement thereof. The rate of travel of the radius shoe and the gripping carriage 85 is coordinated such that incremental distances moved during the first phase by the radial shoe 44 and by the tubular member T are even and uniform at all points so that the radius applied will be uniform.

After the first phase and valve 6 has been automatically cut off, valve 5 is actuated by the automatic switch AU to continue longitudinal feeding of the tubular member T until the indicator 163 engages the limit arm 150 and actuates shaft 164 to shut off the valve 5. At this point, the desired 90° bend at a certain radius is completed. The bending die 68 may then be moved outwardly with respect to die 71 to allow the tubular member T to be removed and another tubular member to be placed therein. This is the basic operational procedure. It should be understood that the actual amount of pretesting involved may depend upon the degree of criticality of the bend involved and the expense and characteristics of the tubular member T to be bent. But, the steps just described for the general operation of the apparatus A will apply to basically all tubular member T to be bent. And further, this basic description will apply to the coiling machine C as far as settings, simultaneous movement during a first bending phase and final longitudinal feeding during the second bending phase to complete the coiling. The only difference is that with the coiling apparatus, the tubing T' may be continually fed to produce a series of coils and thus the distance D will be much longer and require many more reciprocated movements of the carriage 85 to accomplish than that for a single bend on a tubular member T of the apparatus A.

The foregoing disclosure and description of the invention are illustrative and explanatory thereof, and various changes in the size, shape and materials as well as in the details of the illustrated construction may be made without departing from the spirit of the invention.

What is claimed is:

1. Apparatus for bending tubular members such as pipe, comprising:

a frame;

gripping means for gripping said tubular member, said gripping means being mounted on said frame for movement between an initial and final position in a longitudinal direction;

feed means mounted with said frame and attached to said gripping means for moving said gripping means between said initial and final positions;

bending means for bending said tubular member as said feed means moves said gripping means gripping said tubular member from said initial to said advanced position, said bending means including:

a set of bending dies for receiving and bending a tubular member and bending die mount means mounting said bending dies with said frame for adjustable movement in a direction transverse to said longitudinal axis; and a radius setting assembly and radius mount means mounting said radius setting assembly for movement between an initial and a radius applying position in a direction transverse to said longitudinal axis, said radius setting assembly and bending dies cooperating to engage and bend a tubular member to a desired radius with said feed means moving said gripping means from said initial to said final position; and power control means controlling movement of said gripping means, feed means, bending dies and radius setting assembly, said power control means including means for synchronizing movement of said radius setting assembly with movement of said gripping means and said feed means.

2. The structure set forth in claim 1, wherein said synchronizing means includes:

means for adjusting the rate of travel of said radius setting assembly and of said gripping means as moved by said feed means.

3. The structure set forth in claim 1, wherein said radius setting assembly includes:

a movable support assembly and means mounting said movable support assembly for movement transverse to the longitudinal axis of said frame;

a radial shoe mounted on said movable support assembly and having a bearing area for engaging and applying a radius to such tubular member; and said power control means including positioning means for moving said movable support assembly and radial shoe between an ititial position and said final position which is a predesignated radius applying position.

4. The structure set forth in claim 3, wherein said positioning means includes:

means for locking said radial shoe and movable support assembly in said radius applying position.

5. The structure set forth in claim 3, including:

a lock shaft mounted for movement with said movable support assembly and extending outwardly of said movable support assembly;

a position locking sleeve mounted with said frame in position to receive said lock shaft with said movable support assembly in said initial position, said position locking sleeve being mounted with said frame for adjustable movement; and a lock element positioned above said lock shaft with said lock shaft positioned in said position locking sleeve, said lock element dropping into a space between said lock shaft and said position locking sleeve as said movable support assembly moves to said radius applying position to cooperate with said sleeve to support said lock shaft against the bending load applied against said radial shoe during bending.

6. The structure set forth in claim 3, wherein said positioning means includes:

first and second fluid-actuated cylinder assemblies connected on opposite sides of said movable support assembly for moving said movable support assembly with said radial shoe mounted thereon in said transverse direction.

7. The structure set forth in claim 5, including:

said lock shaft, position locking sleeve and lock element combining to provide a lock support assembly, first and lock support assemblies mounted onto said frame and connected to said movable support assembly on opposite sides thereof; and first and second fluid-actuated cylinder assemblies positioned on said opposite sides of said movable support assembly for moving said movable support assembly in said transverse direction between said initial and said radius applying position, said lock support assemblies providing mechanical locking support separate from and additional to locking support provided by said fluid-actuated cylinder assemblies.

8. The structure set forth in claim 3, including:

said movable support assembly including a movable block having a plurality of spaced openings therein; and means for mounting said radial shoe in any of said openings whereby the initial position of the radial shoe with respect to said bending dies is initially adjustable.

9. The structure set forth in claim 3, wherein said radial shoe is:

a roller and means mounting said roller onto said movable support assembly for rollingly engaging such tubular member.

10. The structure set forth in claim 1, wherein said bending means includes:

first and second bending blocks;

first and second bending dies and die mount means mounting said bending dies onto said bending blocks;

bending block mount means mounting said bending blocks for movement transversely to movement of said gripping means and tubular member mounted therein, which is defined as a longitudinal direction; and said power means including bending die positioning means for moving said bending blocks and bending dies between initial and bending positions and bending die position lock means for maintaining said bending dies in said bending position.

11. The structure set forth in claim 10, wherein said bending die positioning means includes:

a fluid-actuated cylinder assembly attached to said first and second bending blocks separate from said frame for moving both of said blocks independently of said frame.

12. The structure set forth in claim 10, including:

first bending die position lock means mounted with said frame for locking the position of said first bending block and die; and said bending die positioning means including means moving said second bending die with respect to said first bending die with said first bending die in a locked position.

13. The structure set forth in claim 10, wherein said bending die positioning means includes:

a first rod extending outwardly from said first die block;

first rod lock means mounted with said frame for locking the position of said rod and thus of said die block against further movement transversely inwardly toward the other of said bending dies; and a second rod mounted with the frame and extending transversely toward said first die block, said second rod being mounted with said frame for adjustable movement inwardly and outwardly toward first die block; and spacer means for positioning between said second rod and said first die block in order to lock said first die block against outward movement in a transverse direction.

14. The structure set forth in claim 10, including:

said first and second bending dies cooperating to provide a curved cylindrical tunnel to receive and impart a bend in such tubular member with said first and second bending dies positioned in said bending position adjacent to each other.

15. The structure set forth in claim 1, wherein said gripping means includes:

a carriage mounted on said frame for movement along the longitudinal axis of said frame; and a pair of gripping elements mounted with said carriage for movement into and out of gripping engagement with a tubular member, and said power means including means moving said gripping elements into and out of such gripping engagement.

16. The structure set forth in claim 15, wherein said power control means includes:

a fluid-actuated cylinder assembly mounted with said frame and with said carriage for moving said carriage from said initial position toward said bending means to said final position.

17. The structure set forth in claim 1, wherein said synchronizing means includes:

means for controlling the movement of said radius setting assembly and said feed means independently of each other.

18. The structure set forth in claim 1, wherein said synchronizing means includes:

means coordinating movement of said radius setting assembly and said feed means such that said radius setting assembly and said gripping means, as controlled by said feed means, arrive at predesignated destinations at the same time during a bend in order to apply the radius of the bend to the pipe evenly.

19. The structure set forth in claim 1, wherein said coordinating means further includes:

means for further activating said feed means to further move such tubular member through said bending dies and into engagement with said radius setting assembly.

20. The structure set forth in claim 3, wherein said positioning means includes:

a fluid-actuated cylinder assembly mounted with said frame and attached to said movable support assembly;

fluid power means for powering said fluid-actuated cylinder assembly for moving said movable support assembly;

a scale positioned with said frame and a travel indicator mounted for movement along said scale; and switch means controlling said fluid power means for powering said fluid-actuated cylinder, said travel indicator cooperating with said fluid power means to stop said movable support assembly when said travel indicator attains a predesignated location on said scale.

21. The structure set forth in claim 1, wherein said power control means includes:

a fluid powered cylinder assembly mounted with said frame and attached to said radius setting assembly for moving same;

said feed means including a fluid powered cylinder assembly mounted with said frame and attached to said gripping means for moving said gripping means between said initial and final positions;

fluid control means for controlling the delivery of pressurized fluid to said fluid power cylinder assemblies for moving said radius setting assembly and said gripping means, and thus moving a tubular member gripped by said gripping means; and said fluid control means including flow control means for adjustable setting the flow of fluid delivered to said fluid powered cylinder assemblies for controlling the rate of travel of said radius setting assembly and of said gripping means.

22. The structure set forth in claim 21, wherein said fluid control means includes:

valve means forming part of said fluid control means for controlling the flow of fluid from said fluid cylinder assemblies in order to control the rate of travel of each.

* * * * *